United States Patent [19]

Hartley et al.

[11] Patent Number: 4,702,417

[45] Date of Patent: Oct. 27, 1987

[54] WATER SPRINKLERS FOR IRRIGATION SYSTEMS

[75] Inventors: Quentin J. S. Hartley, 46 Simontown Road, Fish Hoek, Cape Province; Daniel G. Christen, Cape Town, both of South Africa

[73] Assignee: Quentin John Seaton Hartley, South Africa

[21] Appl. No.: 821,019

[22] Filed: Jan. 21, 1986

[30] Foreign Application Priority Data

Jan. 21, 1985 [ZA] South Africa ..... 85/0468
Aug. 7, 1985 [ZA] South Africa ..... 85/5968

[51] Int. Cl.[4] ..... B05B 3/00; B05B 3/16; B05B 3/06

[52] U.S. Cl. ..... 239/98; 239/242; 239/247; 239/253

[58] Field of Search ..... 239/242, 243, 246–249, 239/252, 255, 98

[56] References Cited

U.S. PATENT DOCUMENTS 12,038 12/1854 Stone ..... 239/98
2,564,639 8/1951 Cuppett et al. ..... 239/98
3,335,959 8/1967 Lockwood .
3,598,316 8/1971 Johnson ..... 239/252 X
3,602,431 8/1971 Lockwood .
3,934,820 1/1976 Phaup .
3,955,764 5/1976 Phaup .
4,182,494 1/1980 Wichman .
4,221,333 9/1980 Rodriguez ..... 239/255 X
4,316,579 2/1982 Ray et al. .

*Primary Examiner*—Andres Kashnikow
*Assistant Examiner*—Patrick N. Burkhart
*Attorney, Agent, or Firm*—Pravel, Gambrell, Hewitt, Kimball & Krieger

[57] ABSTRACT

A water sprinkler which includes a casing and an oscillatory sprinkler head mounted on the casing. The casing includes a water inlet and two water outlet paths. Within the casing there is a structure which cyclically connects the water inlet first to one outlet path and then to the other. The oscillatory sprinkler head includes two spray nozzles which direct water generally tangentially. The nozzles are arranged so that the reaction force when water flows from one nozzle rotates the sprinkler head in one direction and when water flows from the other nozzle the sprinkler head is rotated in the other direction. Each nozzle is in communication with a respective one of the outlet paths. The angle through which the sprinkler head moves can be adjusted.

8 Claims, 8 Drawing Figures

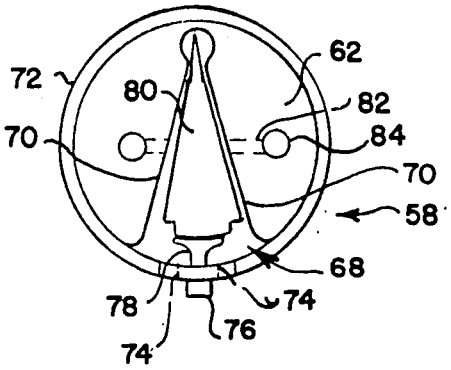
FIG. 5
FIG. 6
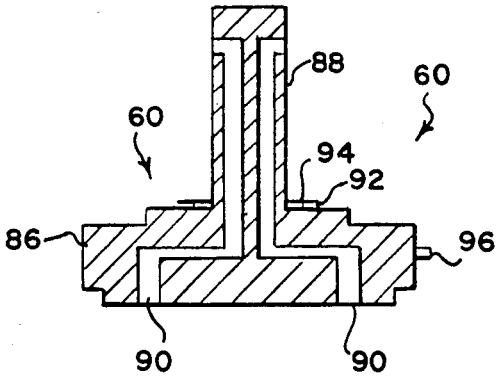
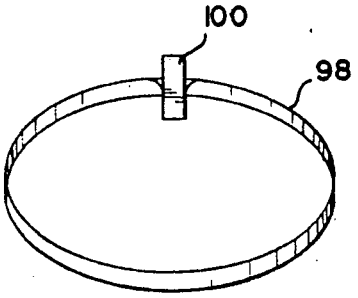
FIG. 7

WATER SPRINKLERS FOR IRRIGATION SYSTEMS

This invention relates to water sprinklers.

BACKGROUND OF THE INVENTION

A multitude of different types of water sprinkler are commercially known. Many of these include sprinkler heads and are adjustable in the sense that the arc through which the head oscillates can be varied. A difficulty with such sprinklers is the complexity of the mechanisms provided to cause the sprinkler head to move back and forth through a predetermined arc and to adjust the magnitude of the arc. Small water driven turbines which themselves drive the head via gear boxes are employed in some sprinklers. Others obtain their drive by causing the water being sprayed to impact on an arm which is mounted for oscillatory movement. By way of a type of escapement mechanism, oscillation of the arm advances the sprinkler head. when the arm encounters a trip mechanism, the position of which is adjustable, the direction of rotation reverses.

Water fed along the water mains to such sprinklers is not necessarily free of foreign particles. Furthermore, particles of soil can enter the sprinkler particularly when a lawn in which sprinklers of the 'pop-up' type are embedded is being cut. The complex mechanisms of the prior sprinklers can readily be jammed by foreign matter, which means that the water then sprays in one direction only.

OBJECTS OF THE INVENTION

The main object of the present invention is to provide a water sprinkler which has a simple mechanism for causing the sprinkler head to oscillate.

Another object of the present invention is to provide a water sprinkler the arc of oscillation of the head of which is simple to adjust.

BRIEF SUMMARY OF THE INVENTION

According to the present invention there is provided a water sprinkler which includes a sprinkler head and a sprinkler body, there being first and second spray nozzles mounted on the sprinkler head which itself is mounted on the sprinkler body for oscillatory motion with respect thereto, the nozzles being so directed that water spraying from one nozzle rotates said sprinkler head in one direction with respect to said sprinkler body, and water spraying from the other nozzle rotates said sprinkler head in the other direction with respect to the sprinkler body, the water sprinkler further including means for directing water alternately to said first and second spray nozzles.

In the preferred form the water directing means comprising a chamber, two water inlets to the chamber and two water outlets from said chamber, each outlet being connected to a respective one of said spray nozzles, a movable valve element in said chamber which element divides said chamber into two sub-chambers and which moves in said chamber in response to water pressure variations in said sub-chambers, one of said inlets and one of said outlets communicating with each sub-chamber, said valve element having two end positions in which it closes-off one or the other of said outlets, and means for obstructing water flow through each of said inlets in turn to cause cyclical water pressure variations in said sub-chambers.

Said chamber is desirably in a structure which oscillates with said sprinkler head and which is within said body, there being first and second water flow obstructing elements within said body, said elements being spaced from one another circumferentially of the body and oscillation of said structure bringing said water inlets into co-operating relationship with said obstructing elements.

To enable the arc through which the sprinkler head oscillates to be adjusted, one of said obstructing elements can be displaceable circumferentially with respect to the other.

To permit simple arc adjustment, there can be a radially protruding bar between said water inlets and an arc adjusting element protruding radially outwardly from said structure, said structure being capable of limited axial displacement with respect to said body, said arc adjusting element normally oscillating in a plane which is clear of the displaceable obstructing element, axial displacement of said sprinkler head for arc adjustment purposes bring said arc adjusting element into co-operating relationship with said displaceable obstructing element.

To control the rate of oscillation, the sprinkler can include means defining a chamber containing a thick viscous fluid, and a member fast in rotation with said sprinkler head located in said chamber and rotating in said fluid.

It is sometimes desirable that the reach of the spray nozzles differ. To this end each of said nozzles can be displaceably mounted on said sprinkler head in such manner that the angles of the axes of the spray orifices with respect to horizontal can be adjusted independently of one another.

BRIEF DESCRIPTION OF THE DRAWINGS

For a better understanding of the present invention, and to show how the same may be carried into effect, reference will now be made, by way of example, to the accompanying drawings in which:

FIG. 5 is a top plan view of the lower part of the structure of FIG. 4,

FIG. 6 is a section through an upper part of the structure of FIG. 4,

FIG. 7 illustrates a ring, and

DETAILED DESCRIPTION OF THE DRAWINGS

Figure 1:
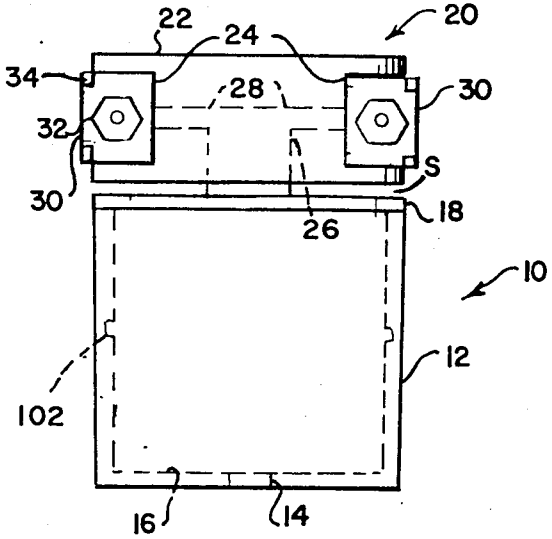
FIG. 1 is an elevation of a water sprinkler.

The water sprinkler 10 illustrated in FIG. 1 of the accompanying drawings includes a sprinkler body in the form of a cylindrical casing 12 having a water inlet 14 in the bottom wall 16 thereof. A filter (not shown) can be mounted in the inlet 14. The upper end of the casing 12 is internally threaded and an end cap 18 is screwed into the casing 12. The end cap 18 has a central aperture and a water flow directing structure (which will be described in more detail hereinafter) passes through the aperture in the end cap 18. The main part of the flow directing structure is within the casing 12 below the end cap 18. An oscillatory sprinkler head 20 is secured to the part of the flow directing structure which protrudes above the cap 18.

The head 20 comprises a generally cylindrical component 22 which has two diametrically opposed flats 24. A cylindrical, axial bore 26 is provided in the component 22, there being radial bores 28 which communicate with the axial bore 26 and which open through the flats 24. The bores 28 are internally threaded at their outer ends. Two nozzle mounts 30 are attached to the component 22, each nozzle mount 30 comprising an externally threaded hollow spigot and a head with a radial bore in it. The spigots of the nozzle mounts are screwed into the tapped outer parts of the bores 28. The radial bore of each nozzle mount 30 communicates with the hollow interior of the spigot of that nozzle mount. A nozzle 32 is pressed or screwed into each nozzle mount radial bore. Two notches 34 are formed in each nozzle mount 30.

Figure 3:
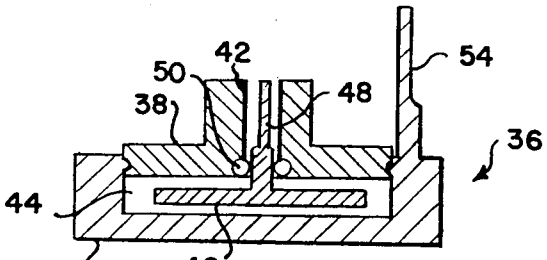
FIG. 3 is a section on the line III—III of FIG. 2.
Figure 2:
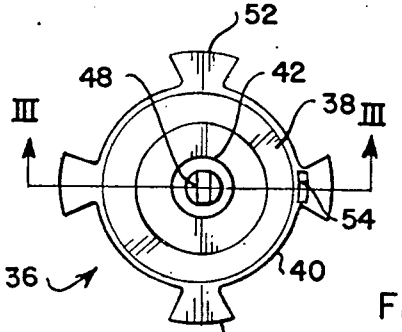
FIG. 2 is a top plan view of a combined rotation slowing unit and end stop.
Figure 8:
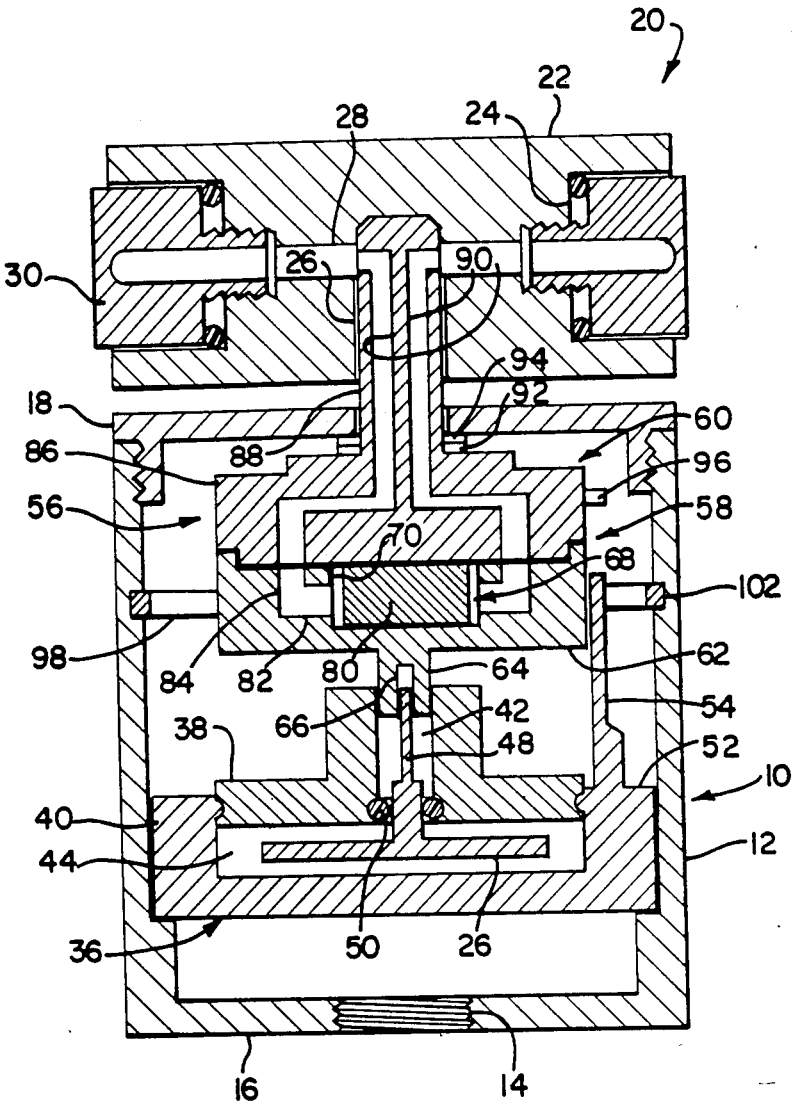
FIG. 8 is a section through the water sprinkler

The unit 36 illustrated in FIGS. 2 and 3 includes a two part casing, the parts of the casing being designated 38 and 40 and being snap-fitted together. The upper casing part 38 has a central bore 42 which leads into the space 44 between the casing parts 38 and 40. A disc 46 is contained within the space 44, an integral rod 48 protruding from the centre of the disc 46. The space 44 contains a very viscous fluid which slows rotation of the disc 46. A sealing ring 50 through which the rod 48 passes prevents the viscous fluid escaping from the space 44. The rod 48, as can be seen from FIG. 2, has a non-circular cross section over the part thereof which is above the ring 50.

The casing part 40 has four radially outwardly directed protrusions 52 which define flow passages therebetween. A flow obstructing element 54 extends upwardly from, and is integral with, the casing part 40.

Figure 4:
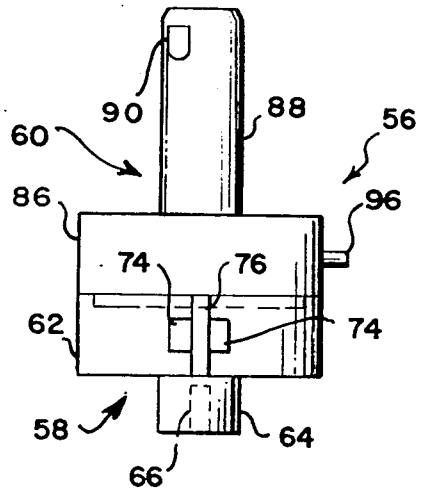
FIG. 4 is a side elevation of a water flow directing structure.

The flow directing structure 56 shown in FIGS. 4, 5 and 6 comprises two parts which have been designated 58 and 60. The lower part 58 consists of a main, substantially circular block 62 from the lower face of which a stem 64 protrudes. The lower end of the stem 64 is formed with a blind socket 66 compatible in shape with the rod 48. The block 62 has a generally triangular chamber 68 therein as best seen in FIG. 5, the chamber 68 being bounded by two diverging flat faces 70 and by a short part of the circular boundary wall designated 72. This short part of the wall 72 has a pair of inlets 74 therein which lead into the triangular chamber 68. Externally of the wall 72 there is a vertically extending bar 76 which lies between the two inlets 74.

A divider 78 extends inwardly from the wall 72, the divider being T-shaped with the 'upright' of the 'T' joining the cylindrical wall 72 between the inlets 74. A movable valve element in the form of a wedge 80 is positioned in the chamber 68 and can move between two end positions. The wedge is shown in its right hand position in which its right hand face is against the right hand face 70 of the chamber 68. In its other position, the other side face of the wedge is against the other face 70. Sealing pads (not shown) are secured to each face of the wedge 80. The rear end of the wedge 80 forms the pivot about which the wedge moves and the divider 78 has a slightly curved face which is the same shape as, and is close to, the end face of the wedge. The faces 70 are substantially radial with respect to the axis about which the wedge 80 oscillates.

A small orifice (not shown) can be provided to feed water into the cavity in which end of the wedge moves, this assisting in removing any particles of dirt.

The wedge 80 can, if desired, be replaced by a flap which has parallel main side faces.

Two outlets 82 lead horizontally from the chamber 68 through the faces 70. These outlets communicate with two vertical bores 84 which open through the top face of the block 62.

The wall 72 projects slightly above the top face of the block 62 so as to form a socket in which the upper part 60 is a push fit.

The wedge 80 divides the chamber 68 into two sub-chambers, one inlet 74 and one outlet 82 leading into each sub-chamber.

The upper part 60 comprises a circular block 86 and a spigot 88. The block 86 is reduced in diameter around the lower periphery thereof (see particularly FIG. 6) so that it can be press fitted into the upwardly open socket formed by the wall 72 of the block 62. Two bores designated 90 extend from the lower face of the block 86 and upwardly through the spigot 88. The bores 90 open in opposite directions through the peripheral wall of the spigot 88 near the top thereof. A sealing and thrust washer 92, and a 'Teflon' washer 94 for reducing friction between relatively rotating parts, encircle the spigot 88. A short pin 96 protrudes from the block 86.

While the part 60 is shown as being of one-piece construction, it is desirably in two parts which are thereafter secured to one another. This facilitates the provision of the bores 90.

The parts 58 and 60 fit together in such manner that the bores 84 and 90 are in communication.

The final component of the sprinkler is a ring 98 (FIG. 7) which includes another flow obstructing element 100. The element 100 extends both above and below the ring 98.

The sprinkler is assembled as follows. The filter (if one is used) is pressed into the inlet 14. The unit of FIGS. 2 and 3 is then placed in the casing 12. There can be protrusions (not shown) on the casing to prevent the unit from dropping into sealing engagement with the bottom wall 16 of the casing. The structure of FIGS. 4, 5 and 6 is then placed in the casing and positioned so that the rod 48 enters the blind socket 66 at the lower end of the stem 64. The last component which is placed in the casing 12 is the ring 98. This ring is located in an internal groove 102 (see FIG. 1) of the casing 12 so that it is at the same level as the upper end of the element 54, which is at the level of the inlets 74. As will be explained in more detail hereinafter, during use of the sprinkler, the elements 54 and 100 come into co-operating relationship with the inlets 74.

The next stage of the assembly procedure is to screw the cap 18 into the upper end of the casing 12 with the spigot 88 protruding through the central aperture in the cap 18. The head 20 is then pressed onto the spigot 88, the spigot entering the bore 26, and being a tight fit therein. Adhesive can be used to ensure that the head will not come off or more with respect to the spigot. When the spigot 88 is pressed into the bore 26, the outlets from the bores 90 communicate with the radially inner ends of the bores 28.

When a source of water under pressure is connected to the inlet 14, it flows through the passages between the protrusions 52 into the annular space which encircles the upper part 38 of the rotation slowing unit and that part of the flow directing structure 56 which is below the end cap 18. The water acts on the underside of the block 62 lifting the entire structure 56 upwardly.

The washer 94 thus bears on the underside of the cap 18 to prevent leakage through the aperture in the cap 18.

Water flows into the chamber 68 through the inlets 74. If the wedge 80 is in the position shown in FIG. 5, then the water enters the left hand sub-chamber. If flows into the left hand bore 82 and up the bores 84 and 90 to the left hand bore 28. Water thus emerges from the left hand nozzle 32 and the reaction effect of the water causes the head 20 and the structure 56 to rotate clockwise as viewed in FIG. 2. The rate of rotation is slowed by the fact that the disc 46 must turn in the viscous fluid.

Rotation of the structure 56 causes the left hand inlet 74 to encounter either the element 54 or the element 100. As the left hand inlet 74 is covered by the obstructing element, the pressure in the left hand sub-chamber drops whereas the pressure in the right hand sub-chamber remains substantially at inlet pressure. The wedge 80 thus moves to its other position in which its closes off the left hand bore 82 and opens the right hand bore 82. Supply of water to the left hand nozzle 32 thus ceases and supply of water to the right hand nozzle commences. The head 20 etc. then rotate anti-clockwise until the right hand port 74 encounters the other element 54, 100 whereupon direction of rotation reverses again.

It will be understood that the element 54 is fixed. The element 100 is, however, adjustable as the ring 98 can be rotated in the casing. Adjustment is effected in one direction simply by gripping the head 20 as the inlet 74 and hence the vertical bar 76 come into close proximity with the element 100. Instead of letting the direction of rotation reverse, the head 20 is turned further in the direction in which it was moving. The bar 76 thus engages the element 100 and rotates the ring 98 in the casing. This changes the angular spacing between the elements 100 and 54 and it is this spacing that controls the angle through which the head 20 moves.

If it is desired to move the ring 98 in the opposite direction, the rotary head 20 is pressed down. Downward movement is possible because water pressure has lifted the flow dividing structure away from the unit 36. When the head 20 is pressed down, the rod 48 slides upwardly in the blind socket 66 to accommodate this movement. This brings the pin 96, which normally rotates at a level above the element 100, down to a level in which it encounters the element 100. By turning the head 20, the pin 96 can be caused to rotate the ring 98. When the head 20 is released, water pressure urges the head and flow directing structure back to the upper position.

When downward pressure is exerted on the head, and hence on the flow directing structure, the washers 92 and 94 move away from the underside of the cap 18 so that water escapes through the aperture in the cap 18 and flows out through the annular slot which is shown at S in FIG. 1. This flushes out any dirt which may be between the cap 18 and the lower face of the rotary head 20.

The angle with respect to horizontal at which water emerges from the nozzles 32 can be adjusted by turning the nozzle mounts 30 in the bores 28. The nozzles can spray at different angles so that their reaches are different. Rotation of the mounts 30 is achieved by means of an appropriate tool applied to the notches 34. The nozzles 32 can readily be changed to permit different flow rates to be obtained.

The sprinkler illustrated can be within a sleeve (not shown) and can move upwardly when water under pressure is supplied to the sleeve. This provides a sprinkler of the 'pop-up' type for buried irrigation systems.

The type of sprinkler illustrated is intended to be fitted to a stand pipe. It can, however, if provided with a heavy base which has a hose connection, be constructed for 'free standing' use on lawns etc.

It is also possible for the head 20 to be in the form of a T-shaped pipe which replaces the component 22. The 'upright' of the T enters the casing 12 and incorporates two vertical bores each of which leads into one arm of the 'crossbar' of the T-shaped pipe. The nozzle mounts 30 are at the outer ends of the cross bar of the T-shaped pipe.

The wedge 80, or the parallel sided flap if one is used, can have domes on opposite sides thereof. These domes enter the bores 82 to ensure that adequate sealing is obtained.

We claim:

1. A water sprinkler which includes a sprinkler head and a sprinkler body, there being first and second spray nozzles mounted on the sprinkler head which itself is mounted on the sprinkler body for oscillatory motion with respect thereto, the nozzles being so directed that water spraying from one nozzle rotates said sprinkler head in one direction with respect to said sprinkler body, and water spraying from the other nozzle rotates said sprinkler head in the other direction with respect to the sprinkler body, a water inlet to the sprinkler, a chamber having first and second outlets connected respectively to said first and second spray nozzles and further having first and second inlets connected to said water inlet, a water flow control element in said chamber and displaceable by water pressure between a first position in which it closes said first outlet and a second position in which it closes said second outlet, and means for obstructing water flow from said water inlet to said chamber through said first and second inlets alternately thereby to displace said element.

2. A water sprinkler which includes a sprinkler head and a sprinkler body, there being first and second spray nozzles mounted on the sprinkler head which itself is mounted on the sprinkler body for oscillatory motion with respect thereto, the nozzles being so directed that water spraying from one nozzle rotates said sprinkler head in one direction with respect to said sprinkler body, and water spraying from the other nozzle rotates said sprinkler head in the other direction with respect to the sprinkler body, the water sprinkler further including means for directing water alternately to said first and second spray nozzles, the water directing means comprising a chamber, two water inlets to and two water outlets from said chamber, each outlet being connected to a respective one of said spray nozzles, a movable valve element in said chamber which element divides said chamber into two sub-chambers and which moves in said chamber in respect to water pressure variations in said sub-chambers, one of said inlets and one of said outlets communicating with each sub-chamber, said valve element having two end positions in which it closes-off one or the other of said outlets, and means for obstructing water flow through each of said inlets in turn to cause cyclical water pressure variations in said sub-chambers.

3. A water sprinkler as claimed in claim 2, wherein said valve element is pivotally mounted at one end thereof and oscillates in said chamber about its pivotal mounting.

4. A water sprinkler as claimed in claim 3, wherein said outlets are in walls of said chamber which extend substantially radially with respect to the axis about which said element oscillates, said element having opposed faces which engage said walls.

5. A water sprinkler as claimed in claim 2, wherein said chamber is in a structure which oscillates with said sprinkler head and which is within said body, there being first and second water flow obstructing elements within said body, said elements being spaced from one another circumferentially of the body and oscillation of said structure bringing said water inlets into co-operating relationship with said obstructing elements.

6. A sprinkler as claimed in claim 5, wherein one of said obstructing elements is displaceable circumferentially with respect to the other thereby to enable the arc through which the sprinkler head oscillates to be adjusted.

7. A sprinkler as claimed in claim 6, wherein said inlets are side-by-side on said structure and there is, between said inlets, a radially outwardly protruding bar.

8. A sprinkler as claimed in claim 5 or 6, wherein there is an arc adjusting element protruding radially outwardly from said structure, said structure being capable of limited axial displacement with respect to said body, said arc adjusting element normally oscillating in a plane which is clear of the displaceable obstructing element, axial displacement of said sprinkler head for arc adjustment purposes bring said arc adjusting element into co-operating relationship with said displaceable obstructing element.

* * * * *